United States Patent [19]

Riesen

[11] 4,309,880

[45] Jan. 12, 1982

[54] PATTERNING DEVICE FOR A WARP KNITTING MACHINE

[75] Inventor: Peter Riesen, Elgg, Switzerland

[73] Assignee: Sulzer Brothers Ltd., Winterthur, Switzerland

[21] Appl. No.: 150,907

[22] Filed: May 19, 1980

[30] Foreign Application Priority Data

Jun. 12, 1979 [CH] Switzerland ..... 5470/79

[51] Int. Cl.[3] ..... D04B 23/00

[52] U.S. Cl. ..... 66/207; 474/166

[58] Field of Search ..... 66/207, 203, 204, 208; 474/166, 172

[56] References Cited

U.S. PATENT DOCUMENTS 4,139,997 2/1979 Riesen ..... 66/207

*Primary Examiner*—Ronald Feldbaum

*Attorney, Agent, or Firm*—Kenyon & Kenyon

[57] ABSTRACT

The pattern mechanism for controlling the shogging of guide bars or guide belts includes tension elements which are actuated by final control elements in accordance with a pattern. In order to save space without entangling the groups of tension elements, these tension elements are guided on guide pulleys which are disposed in groups of three. In addition, the pulleys of each group are disposed in overlapping relation to each other.

12 Claims, 3 Drawing Figures

PATTERNING DEVICE FOR A WARP KNITTING MACHINE

This invention relates to a patterning device for a warp knitting machine.

As is known, warp knitting machines are constructed with a number of operating components which require controls to effect their motion. For example, some warp knitting machines have a multiplicity of guide bars or guide belts through which warp yarns are delivered for knitting which carry out end wise movements or shogs. Generally, the amount of endwise movement or shog given to the guide bars determines to a great extent the pattern, weight, appearance and physical properties of the knitted fabric. In the past, various types of mechanism have been used to effect a guide bar shog motion. In one case, it has been known to guide the guide bars via tension elements which reciprocate in the shogging direction and which are, in turn, actuated by final control elements in accordance with the pattern. Such a system consists of "additive gearing" which is adapted to control the shogging of the guide bars. However, the resulting system is very bulky insofar as the warp knitting machine is concerned, particularly in the case of machines using lapping belts which are present in vary large numbers.

It has been proposed to entangle the closely-packed tension elements by guiding the elements on spaced apart pulleys in a different direction, particularly at an angle to the motion of those portions of the tension elements which are directly connected to the lapping belts. However, this feature does not substantially reduce the bulk of the assembly.

Accordingly, it is an object of the invention to reduce the space taken up by a patterning device for a warp knitting machine.

It is another object of the invention to provide a patterning device for a warp knitting machine which is of relatively simple compact construction.

Briefly, the invention provides a patterning device for a warp knitting machine which is comprised of a plurality of guide bars, a plurality of tension elements and a plurality of guide pulleys with each pair of adjacent pulleys disposed in overlapping relation to each other. Each tension element is connected to a guide bar for reciprocating the guide bar in a shogging direction while each guide pulley is disposed with a tension element thereon.

The guide pulleys are arranged in a row with each pulley constructed, for example, of a stationary disc which is secured to a stationary frame and an outer ring which is rotatably mounted about the disc. In addition, each ring of a respective pair of pulleys is mounted on an axis of rotation offset from the rotatable ring of the other pulley of the pulley pair. This allows the two pulleys of each group to accommodate different positions of the tension elements passing about the pulleys.

The patterning device also includes a plurality of final control elements which are disposed substantially at right angles to the guide pulleys for actuating the tension elements. These final control elements make up an "additive gearing".

With the above construction, the overall pattern mechanism can be reduced, for example to half the size previously required.

In one embodiment, two adjacent tension elements may be associated with three guide pulleys. In this case, the two outer pulleys are concentric with each other and offset from the middle pulley. Also, one of the tension elements is divided into two parallel sections and is disposed about the outer pulleys while the remaining tension element is disposed about the middle pulley so that the two tension elements are guided in parallel.

These and other objects and advantages of the invention will become more apparent from the following detailed description and appended claims taken in conjunction with the accompanying drawings in which:

FIG. 3 illustrates the coupling of tension belts shown in FIG. 1 to belt elements leading to the final control elements.

Figure 1:
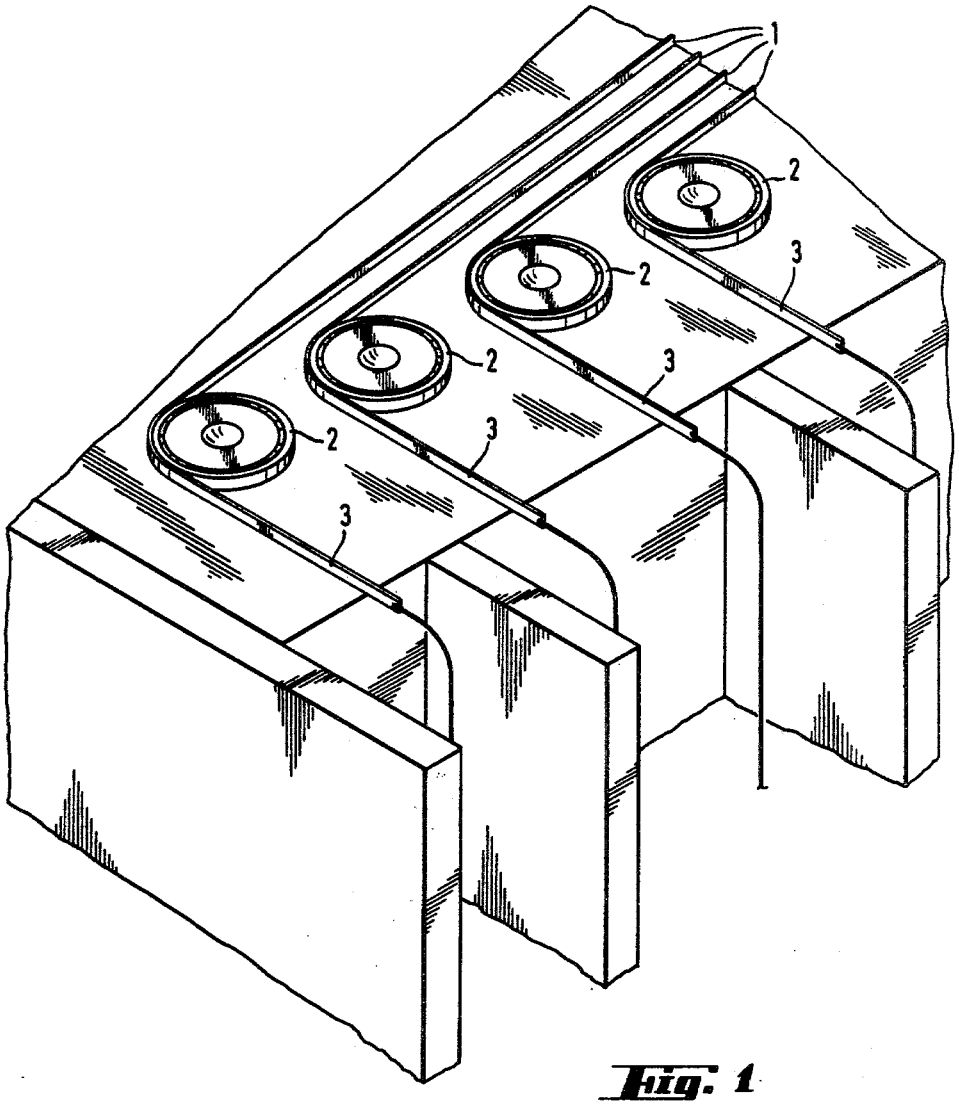
FIG. 1 illustrates a part perspective view of a part of a known pattern mechanism.

Referring to FIG. 1, it has been known to use a pattern mechanism wherein parts 1 of a multiplicity of tension belts coming from a multiplicity of guide bars (not shown) are each guided about a guide pulley 2 whereas parts 3 of the tension belts leaving the pulleys 2 are guided relative to an additive gearing (not shown) which is substantially of the type disclosed in German O.S. No. 26 10 888 and U.S. Pat. No. 4,139,997.

Figure 2:
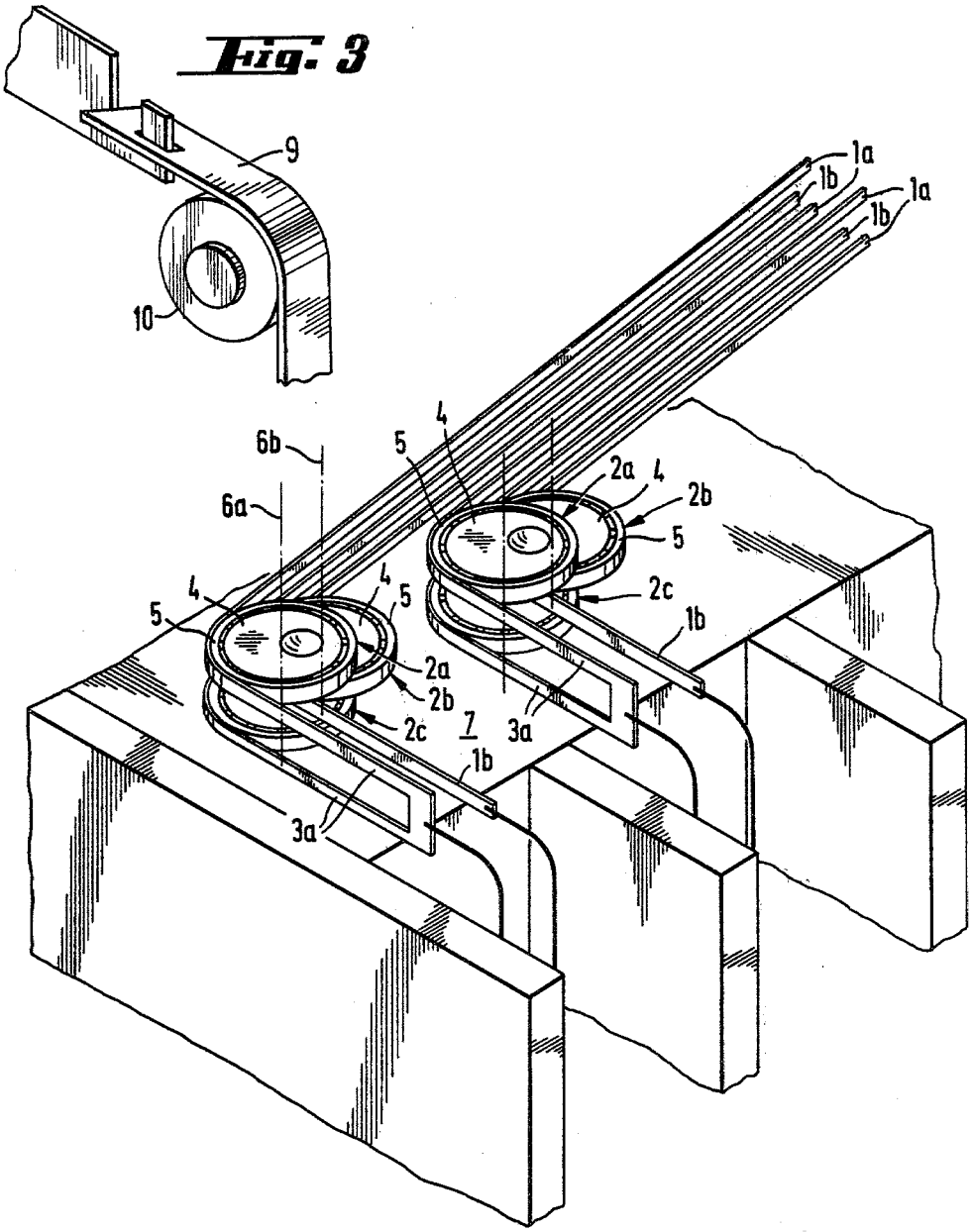
FIG. 2 illustrates a part perspective view of a pattern mechanism according to the invention.

Referring to FIG. 2, a pattern mechanism according to the invention is of similar construction to that of FIG. 1 except that the tension belts coming from the guide bars (not shown) are guided on overlapping pulleys. As a result, the entire mechanism is reduced to about half the size as compared with that of FIG. 1.

More specifically, the pattern mechanism is comprised of a frame F of conventional structure on which a plurality of groups of guide pulleys *2a, 2b, 2c* are mounted. As shown, each group of pulleys is formed of three pulleys which are disposed in overlapping relation with the two outer pulleys *2a, 2c* being concentric with each other and offset from the middle pulley *2b*. Each pulley *2a, 2b, 2c*, is comprised of a stationary disc 4 which is mounted on the frame F via a common bolt S and an outer ring 5 which is rotatably mounted about the disc 4. Each ring 5 may be in the form of a ball race to accomodate a plurality of balls 8 between the disc 4 and the ring 5. As indicated, the rings 5 of the outer pulleys *2a, 2c* are rotatable about an axis of rotation *6a* which is mutually offset from the axis of rotation *6b* of the ring 5 of the middle pulley *2b* of each group.

The patterning device also includes a plurality of guide bars (not shown) of conventional construction and a plurality of tension elements or belts *1a, 1b* which are connected to a respective guide bar (not shown) for reciprocating each guide bar in a shogging direction. In this regard, it is noted that the groups of pulleys are arranged on the frame F in a row parallel to the shogging direction of the guide bars (not shown).

As shown, the tension belts *1a, 1b* are disposed in pairs. Also, one tension belt *1a* is divided into two parallel sections with these sections being disposed about the outer guide pulleys *2a, 2c*. The remaining tension belt *1b* of each pair of belts is disposed about the middle pulley *2b*. The tension belts *1a, 1b* are disposed about the guide pulleys *2a, 2b, 2c* in a right angled relation at a turning point 7 of the mechanism. In addition, the axis of rotation *6b* of the middle pulley *2b* is offset from the axis of rotation *6a* of the outer pulleys *2a, 2c* in directions perpendicular to each of the portions of the tension elements. In this way, the tension belts are guided in parallel through the turning point 7. The tension belts are shown in their end position.

The terminal ends 3*a* of each tension belt 1*a* are joined together as indicated. In addition, the tension belts are coupled in the manner shown in FIG. 3 to belt elements 9, which can move about a guide roller 10 through a 90° angle to the final control elements which are housed in pairs in the passage ways 11 formed by the parallel walls 12 of frame F.

The final control elements (not shown) act as an additive gearing in known manner, for instance in accordance with U.S. Pat. No. 4,139,997. They are disposed substantially at right angles to the guide pulleys 2*a*, 2*b*, 2*c* for actuating the tension belts 1*a*, 1*b*.

The invention thus provides a patterning mechanism for a warp knitting machine which is of simple compact construction. Further, the invention provides a pattern mechanism which is able to guide a multiplicity of closely packed tension elements or belts in a minimum of space.

What is claimed is:

1. A patterning device for a warp knitting machine comprising
   - a plurality of guide bars;
   - a plurality of tension elements, each said tension element being connected to a respective guide bar for reciprocating said respective guide bar; and
   - a plurality of guide pulleys, each said guide pulley being disposed with a respective tension element thereon and each pair of adjacent pulleys being disposed in overlapping relation to each other.

2. A patterning device as set forth in claim 1 wherein each pulley includes a stationary disc and an outer ring rotatably mounted about said disc, each said ring of a respective pair of pulleys being disposed on an axis of rotation offset from the other ring of said respective pair of pulleys.

3. A patterning device as set forth in claim 1 which further comprises a plurality of final control elements disposed substantially at right angles to said guide pulleys for actuating said tension elements.

4. A patterning device for a warp knitting machine comprising
   - a plurality of guide bars;
   - a plurality of pairs of tension elements, one of each said pair of tension elements being divided into two parallel sections, each said tension element being connected to a respective guide bar for reciprocating said respective guide bar; and
   - a plurality of groups of guide pulleys, each said group including three guide pulleys disposed in overlapping relation with the two outer pulleys being concentric and offset from the middle pulley, each divided tension element being disposed about said outer pulleys of a respective group of pulleys with the remaining tension element of each pair being disposed about a respective middle pulley.

5. A pattern mechanism for a warp knitting machine comprising
   - a frame;
   - a plurality of groups of guide pulleys mounted on said frame, each said group including at least two pulleys disposed in overlapping relation with one of said two pulleys being disposed on an axis of rotation offset from the axis of rotation of the other of said two pulleys; and
   - a plurality of elongated tension elements, each said tension element being disposed about a respective one of said guide pulleys.

6. A pattern mechanism as set forth in claim 5 wherein said groups of guide pulleys are disposed in a row and which further comprises a plurality of final control elements disposed substantially at right angles to said guide pulleys for actuating said tension elements.

7. A pattern mechanism as set forth in claim 5 wherein each guide pulley includes a stationary disc mounted on said frame and a ring rotatably mounted about said disc.

8. A pattern mechanism as set forth in claim 7 wherein said ring includes a ball race and which further comprises a plurality of balls disposed between said disc and said ring of each pulley.

9. A pattern mechanism as set forth in claim 5 wherein each group of pulleys includes an outer pair of coaxially disposed pulleys and a middle pulley eccentrically mounted between said outer pulleys and wherein respective ones of said tension elements are divided into two parallel sections with said sections disposed about said outer pairs of pulleys and each remaining tension element is disposed about a respective middle pulley.

10. A pattern mechanism as set forth in claim 5 which further comprises a plurality of guide bars, each said guide bar being connected at one end to a respective tension element for reciprocating in a shogging direction.

11. A pattern mechanism as set forth in claim 10 wherein said groups of guide pulleys are disposed in a row parallel to said shogging direction.

12. A pattern mechanism as set forth in claim 5 wherein each tension element is disposed about a respective guide pulley with a pair of portions disposed in perpendicular relation to each other and wherein each said axis of rotation of each one of said two pulleys is offset from said axis of rotation of the other of said two pulleys in directions perpendicular to each of said tension element portions.

* * * * *